US008875312B2

(12) United States Patent
Kolmes et al.

(10) Patent No.: US 8,875,312 B2
(45) Date of Patent: Nov. 4, 2014

(54) MODULAR CUT AND ABRASION RESISTANT PROTECTIVE GARMENT AND PROTECTIVE GARMENT SYSTEM

(75) Inventors: Nathaniel H. Kolmes, Hickory, NC (US); Fred Elton Driver, Hickory, NC (US); Walter Gordon Schulein, Little Egg Harbor, NJ (US); Lynn J. Bell, Lincoln University, PA (US)

(73) Assignee: Supreme Elastic Corporation, Conover, NC (US)

( * ) Notice: Subject to any disclaimer, the term of this patent is extended or adjusted under 35 U.S.C. 154(b) by 1585 days.

(21) Appl. No.: 11/251,928

(22) Filed: Oct. 18, 2005

(65) Prior Publication Data

US 2007/0094761 A1 May 3, 2007

(51) Int. Cl.

| | |
|---|---|
| ***A41D 13/015*** | (2006.01) |
| ***A41D 31/00*** | (2006.01) |
| ***A41D 13/05*** | (2006.01) |

(52) U.S. Cl.

CPC ..... *A41D 13/015* (2013.01); *A41D 31/0055* (2013.01); *A41D 13/05* (2013.01)

USPC ..... 2/69; 2/2.5

(58) Field of Classification Search

USPC ..... 2/69, 2.5

See application file for complete search history.

(56) References Cited

U.S. PATENT DOCUMENTS

| | | | | | |
|---|---|---|---|---|---|
| 1,739,112 | A | * | 12/1929 | Wisbrod | 2/2.5 |
| 2,052,684 | A | * | 9/1936 | Wlsbrod | 2/2.5 |
| 4,384,449 | A | * | 5/1983 | Byrnes et al. | 57/210 |
| 4,467,476 | A | | 8/1984 | Herbert | |
| 4,497,069 | A | | 2/1985 | Braunhut | |
| 4,777,789 | A | | 10/1988 | Kolmes et al. | |
| 4,838,017 | A | | 6/1989 | Kolmes et al. | |
| 4,936,085 | A | | 6/1990 | Kolmes et al. | |
| 5,060,314 | A | | 10/1991 | Lewis | |
| 5,072,453 | A | | 12/1991 | Widder | |
| 5,073,985 | A | * | 12/1991 | Stone et al. | 2/2.5 |
| 5,119,512 | A | | 6/1992 | Dunbar et al. | |
| 5,157,792 | A | * | 10/1992 | Allen et al. | 2/2.5 |
| 5,177,948 | A | | 1/1993 | Kolmes et al. | |
| 5,325,538 | A | * | 7/1994 | Schoenweiss et al. | 2/2.5 |
| 5,382,264 | A | | 1/1995 | Sharma | |
| 5,423,168 | A | | 6/1995 | Kolmes et al. | |

(Continued)

FOREIGN PATENT DOCUMENTS

| | | |
|---|---|---|
| CN | 2209884 Y | 10/1995 |
| CN | 2552367 Y | 5/2003 |
| JP | 48-36021 | 10/1973 |

OTHER PUBLICATIONS

U.S. Appl. No. 60/730,829, filed Oct. 28, 2005, Kolmes.

(Continued)

*Primary Examiner* — Clinton T Ostrup

(74) *Attorney, Agent, or Firm* — Oblon, Spivak, McClelland, Maier & Neustadt, L.L.P.

(57) ABSTRACT

A modular protective garment includes first and second protective components. The first protective component is configured to protect a portion of a body of a wearer of the garment. The first protective component includes a fabric made from a composite material, the fabric permitting air and water vapor to flow therethrough and being light-weight. The second protective component is also configured to protect a portion of the body of the wearer. A connector releasably attaches the first and second components.

21 Claims, 5 Drawing Sheets

(56) References Cited

U.S. PATENT DOCUMENTS

| | | | | |
|---|---|---|---|---|
| 5,495,621 | A * | 3/1996 | Kibbee | 2/2.5 |
| 5,500,025 | A | 3/1996 | Sharma | |
| 5,584,737 | A | 12/1996 | Luhtala | |
| 5,628,172 | A | 5/1997 | Kolmes et al. | |
| 5,632,137 | A | 5/1997 | Kolmes et al. | |
| 5,644,907 | A | 7/1997 | Kolmes et al. | |
| 5,655,358 | A | 8/1997 | Kolmes | |
| 5,673,836 | A | 10/1997 | Bush | |
| 5,694,981 | A * | 12/1997 | Stanhope et al. | 139/383 R |
| 5,717,999 | A | 2/1998 | Lurry | |
| 5,718,000 | A | 2/1998 | Ost et al. | |
| 5,754,982 | A | 5/1998 | Gainer | |
| 5,845,476 | A | 12/1998 | Kolmes | |
| 5,894,600 | A | 4/1999 | Ghenefront | |
| 6,029,270 | A * | 2/2000 | Ost et al. | 2/2.5 |
| 6,158,056 | A | 12/2000 | Riley | |
| 6,182,288 | B1 * | 2/2001 | Kibbee | 2/2.5 |
| 6,185,745 | B1 | 2/2001 | Alger | |
| 6,212,914 | B1 | 4/2001 | Kolmes et al. | |
| 6,230,524 | B1 | 5/2001 | Kolmes et al. | |
| 6,263,509 | B1 | 7/2001 | Bowen | |
| 6,341,483 | B1 | 1/2002 | Kolmes et al. | |
| 6,349,531 | B1 | 2/2002 | Kolmes et al. | |
| 6,351,932 | B1 | 3/2002 | Hummel | |
| 6,363,703 | B1 | 4/2002 | Kolmes | |
| 6,367,290 | B2 | 4/2002 | Kolmes et al. | |
| 6,381,940 | B1 | 5/2002 | Kolmes et al. | |
| 6,467,251 | B1 | 10/2002 | Kolmes | |
| RE38,136 | E | 6/2003 | Kolmes | |
| 6,698,024 | B2 | 3/2004 | Graves et al. | |
| 6,892,392 | B2 * | 5/2005 | Crye et al. | 2/2.5 |
| 7,111,445 | B2 | 9/2006 | Threlkeld et al. | |
| 7,178,323 | B2 | 2/2007 | Kolmes et al. | |
| 7,214,425 | B2 | 5/2007 | Kolmes et al. | |
| 2004/0199983 | A1 * | 10/2004 | Gillen et al. | 2/456 |
| 2005/0015837 | A1 * | 1/2005 | Saito | 2/2.5 |
| 2005/0086924 | A1 | 4/2005 | Kolmes | |
| 2005/0186259 | A1 | 8/2005 | Threlkeld et al. | |
| 2006/0088712 | A1 | 4/2006 | Threlkeld et al. | |
| 2007/0094761 | A1 | 5/2007 | Kolmes et al. | |
| 2007/0137164 | A1 | 6/2007 | Kolmes et al. | |
| 2007/0144135 | A1 | 6/2007 | Kolmes et al. | |
| 2007/0271965 | A1 | 11/2007 | Kolmes et al. | |

OTHER PUBLICATIONS

U.S. Appl. No. 11/778,340, filed Jul. 16, 2007, Schulein.
U.S. Appl. No. 61/020,790, filed Jan. 14, 2008, Kolmes, et al.
U.S. Appl. No. 12/134,446, filed Jun. 6, 2008, Kolmes, et al.
U.S. Appl. No. 12/206,834, filed Sep. 9, 2008, Schulein, et al.
U.S. Appl. No. 12/538,218, filed Aug. 10, 2009, Schulein, et al.
U.S. Appl. No. 12/551,736, filed Sep. 1, 2009, Kolmes, et al.
Office Action issued Sep. 10, 2010, in Chinese Patent Application No. 200680044756.X, filed Oct. 3, 2006 (with English summary).
Japanese Office Action issued Jul. 19, 2011, in Patent Application No. 2008-536599 (English-language translation only).
Office Action issued Jan. 23, 2013, in Canadian patent application No. 2,626,243.
U.S. Appl. No. 14/023,977, filed Sep. 11, 2013, Kolmes et al.

* cited by examiner

MODULAR CUT AND ABRASION RESISTANT PROTECTIVE GARMENT AND PROTECTIVE GARMENT SYSTEM

BACKGROUND OF THE INVENTION

1. Field of the Invention

The present invention relates to protective wear, a modular garment system, and more specifically to a modular protective garment system.

2. Discussion of the Related Art

In many industries and professions there is a need for protective wear that is cut and/or abrasion resistant, yet light-weight and comfortable for the wearer. From maintenance workers crawling through HVAC ventilation shafts to weekend warriors participating in various sporting events, many individuals need protection from cuts and scrapes as they go about their daily activities.

Typical examples of previous garments and modular systems are disclosed in U.S. Publication No. 2004/0199983 to Gillen; U.S. Pat. No. 6,892,392 to Crye; U.S. Pat. No. 6,698,024 to Graves; U.S. Pat. No. 6,263,509 to Bowen; U.S. Pat. No. 6,185,745 to Alger; U.S. Pat. No. 6,182,288 to Kibbee; U.S. Pat. No. 6,158,056 to Riley; U.S. Pat. No. 6,029,270 to Ost; U.S. Pat. No. 5,894,600 to Chenefront; U.S. Pat. No. 5,754,982 to Gainer; U.S. Pat. No. 5,718,000 to Ost; U.S. Pat. No. 5,717,999 to Lurry; U.S. Pat. No. 5,673,836 to Bush; U.S. Pat. No. 5,584,737 to Luhtala; U.S. Pat. No. 5,495,621 to Kibbee; U.S. Pat. No. 5,072,453 to Widder; U.S. Pat. No. 5,060,314 to Lewis; U.S. Pat. No. 4,497,069 to Braunhut; and U.S. Pat. No. 4,467,476 to Herbert, the disclosures of which are incorporated by reference herein in their entirety.

However, these and other known such garments suffer from numerous disadvantages. The garments are often unable to provide a satisfactory level of protection to a wearer of the garment, are easily damaged, are unwieldy and uncomfortable to the wearer, do not permit airflow therethrough, do not permit the escape of excess water vapor from the skin of the wearer, and often require the use of specialized over- or undergarments. Most of the modular systems in these patents require a central vest portion to be present in order to attach the other parts of the system.

Thus there is a need for a truly modular protective wear system that permits the wearer to selectively cover those areas of the body that need protection, without the necessity for extraneous central vest portions or otherwise unneeded sections of garment. Further, there is a need for such wear to be flexible, comfortable and useable as an underclothing garment, so as not to be visible to the casual observer.

SUMMARY OF THE INVENTION

It is an object of the present invention to overcome these or other disadvantages of known modular garments.

It is a further object of the present invention to provide a modular garment system that can be one or more of easily reconfigured, able to provide a satisfactory level of cut and/or abrasion resistance protection to the wearer, able to resist damage, light-weight, comfortable, able to permit airflow therethrough, able to permit the escape of excess water vapor from the skin of the wearer, able to be worn directly against the skin as an undergarment, and able to be worn under street clothes or a uniform without the use of specialized over- or undergarments.

These and other objects of the present invention can be provided by a modular protective garment including first and second protective components. The first protective component is configured to protect a portion of a body of a wearer of the garment. The second protective component is also configured to protect a portion of the body of the wearer. Each of the first and second protective components comprises a fabric made from a composite cut and abrasion resistant yarn, the fabric permitting air and water vapor to flow therethrough and being light-weight. A connector releasably attaches the first and second protective components.

In a preferred embodiment the first protective component includes a front component configured to cover a chest of the wearer, and the second component includes a back component configured to cover a back of the wearer.

In another preferred embodiment the first component includes a left arm component configured to protect a left arm of the wearer, and the second component includes a right arm component configured to protect a right arm of the wearer.

The present invention can further provide a method of protecting a person. The method includes disposing on a wearer a first protective component configured to protect a portion of a body of the wearer, the first protective component including a fabric made from a composite yarn, the fabric permitting air and water vapor to flow therethrough and being light-weight, disposing on the wearer a second protective component configured to protect a portion of the body of the wearer, and attaching the first and second protective components.

BRIEF DESCRIPTION OF THE DRAWINGS

A more complete appreciation of the present invention, and many of the attendant advantages thereof, will be readily ascertained and obtained as the same becomes better understood by reference to the following detailed description when considered in connection with the accompanying drawings, wherein.

DETAILED DESCRIPTION OF THE INVENTION

Figure 1:
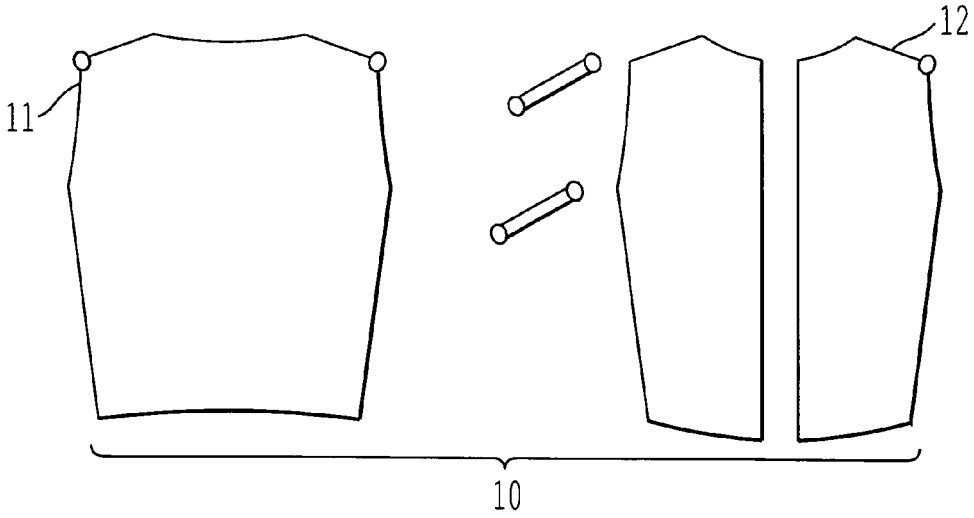
FIG. 1 is an exploded front view showing an upper body protecting component in accordance with the present invention.

Non-limiting examples of preferred embodiments of the present invention are now described with reference to the drawings. In the drawings like reference numbers throughout the several views identify like or similar elements.

The present invention can provide a garment, and more specifically can provide a modular protective garment. The modular protective garment can be one or more of easily reconfigured, able to provide a satisfactory level of injury protection to the wearer, able to resist damage, able to permit airflow therethrough, able to permit the escape of excess water vapor from the skin of the wearer, light-weight, comfortable, able to be worn directly against the skin as an undergarment, and able to be worn under street clothes or a uniform without requiring the use of specialized over- or undergarments.

The modular protective garment can provide the above advantages, including the prevention or reduction of injury to the wearer, the resistance to damage, the light-weight construction, the ability to permit air and water vapor flow, as a result of the material from which separate, modular protecting components are made. In a preferred embodiment of the invention, the modular protecting components include fabrics made from cut and/or abrasion resistant composite yarns. Within the context of the present invention the term "composite yarn" refers to a yarn prepared from two or more yarns (or "ends"), which can be the same or different. Composite yarn can occur in a variety of forms wherein the two or more ends are in differing orientations relative to one another, so long as the final composite yarn containing the two or more ends is stably assembled (i.e. will remain intact unless forcibly separated or disassembled). The two or more ends can, for example, be parallel, wrapped one around the other(s), twisted together, or combinations of any or all of these, as well as other orientations, depending on the properties of the composite yarn desired. Suitable composite yarns which may be formed into the fabric by any desired process, preferably knit or woven into the fabric, include, but are not limited to, those as described in U.S. Pat. Nos. 4,777,789, 4,838,017, 4,936,085, 5,177,948, 5,628,172, 5,632,137, 5,644,907, 5,655,358, 5,845,476, 6,212,914, 6,230,524, 6,341,483, 6,349,531, 6,363,703, 6,367,290, and 6,381,940, each to Kolmes, the contents of each of which are hereby incorporated by reference. The fabric may contain one or more composite yarns, either alone or in combination with any other natural or synthetic fiber. Such natural or synthetic fibers include, but are not limited to, cotton, wool, nylon, polyester, rayon, cellulose acetate, etc. Each of the above noted patents disclose composite yarns and fabrics that are well suited for use in the protecting components of the modular protective garment disclosed herein. Each of these materials is one or more of strong, light-weight, easily woven into a fabric, resistant to damage, able to permit air and water vapor flow, and able to prevent or decrease the seriousness of an injury from cuts or abrasions to a portion of the body of the wearer covered by the fabric.

More specifically, the present invention can provide a modular protective garment that can protect one or more of the hands, arms, shoulders, upper body, lower body, legs, shins, and feet of the wearer of the garment. It is to be understood that any of the following modular components of the protective garment can be used alone to protect one or more specific portions of the body of the wearer, or can be used in conjunction with one or more other components.

Figure 2A:
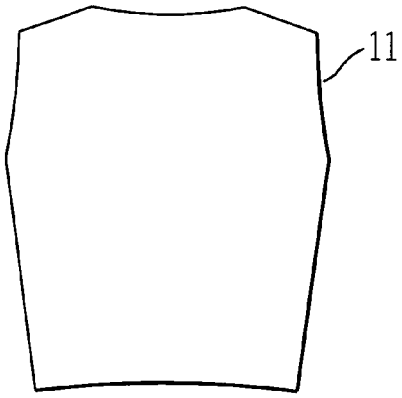
FIG. 2*a* is a detail front view showing an interior side of a back component of the upper body component of FIG. 1.
Figure 2B:
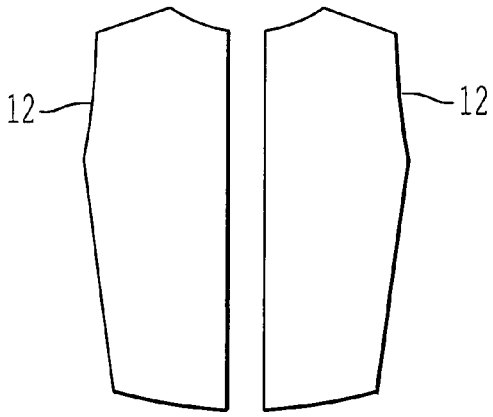
FIG. 2*b* is a detail front view showing exterior sides of front components of the upper body component of FIG. 1.

FIG. 1 is an exploded front view showing an upper body protecting component in accordance with the present invention, FIG. 2*a* is a detail front view showing an interior side of a back component of the upper body component of FIG. 1, and FIG. 2*b* is a detail front view showing exterior sides of front components of the upper body component of FIG. 1. The upper body component can be used to protect at least a portion of the upper body of the wearer from injury.

In the specific embodiment shown in the figures, the upper body protecting component 10 can include a back component 11 and at least one front component 12. Preferably, at least two front components 12 are included in the upper body component 10. The use of multiple front components 12 allows the wearer to more easily put on or take off the upper body component 10. Further, the use of multiple front components 12 allows the wearer better access to his or her upper body without removal of the upper body component 10 in its entirety.

In a preferred embodiment, the front components 12 are removably attached to the back component 11, such that the front components 12 can be separated from the back component 11 without damage to any of the components of the upper body component 10. By this arrangement, a better fit can be obtained by the wearer of the upper body component 10. Specifically, differently sized back and front components 11 and 12 can be used with one another to increase the comfort of the wearer of the upper body component 10. Further, because the back and front components 11 and 12 can be removed separately from the upper body component 10, damage to less than all of the back and front components 11 and 12 does not necessitate replacement of the entire upper body component 10. Rather, only the damages components themselves can be replaced to repair the upper body component 10.

The back and front components 11 and 12 can be removably connected to one another by any of a number of fasteners or attachment devices or methods, including known fasteners or attachment devices and methods. In a preferred embodiment, corresponding and cooperating hook and loop fasteners (e.g., VELCRO) are disposed on the back and front components 11 and 12. Alternatively, the back and front components 11 and 12 can be connected to one another by a set of interlocking teeth (i.e., a zipper), buttons, snaps, or the like.

It is to be understood that although the drawings show preferred embodiments of the upper body component 10 in which the back and front components 11 and 12 are removably connected to one another, the back and front components 11 and 12 need not be removable and separable from one another. For example, the back and front components 11 and 12 can be irremovably attached to one another, such that attempted separation of the back or front components 11 and 12 can cause damage to these components. By this arrangement, unintentional separation, misplacement, or loss of the back and front components 11 and 12 can be minimized.

Figure 3:
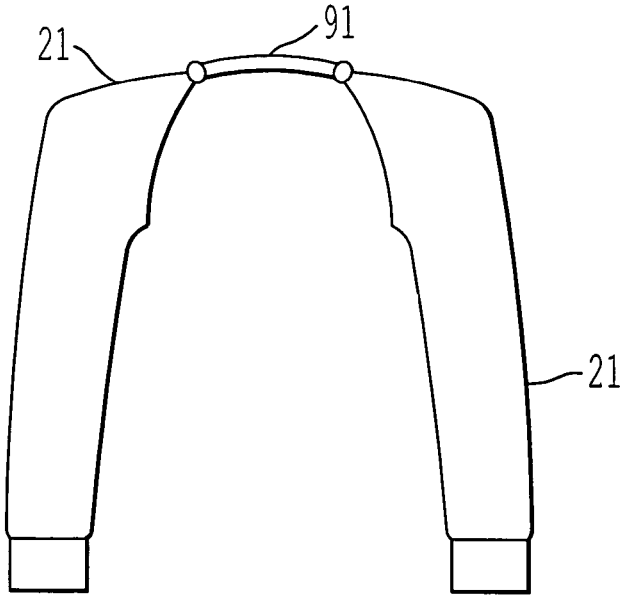
FIG. 3 is a front view of left and right arm protecting components, which can be used with or separate from the upper body component of FIG. 1.
Figure 4:
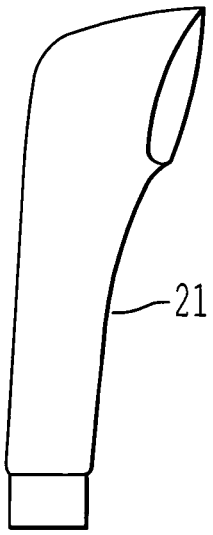
FIG. 4 is a detail front view of the right arm protecting component of FIG. 3.

FIG. 3 is a front view of left and right arm protecting components, which can be used with or separate from the upper body protecting component of FIG. 1, and FIG. 4 is a detail front view of the right arm protecting component of FIG. 3. The arm components can be used to protect at least a portion of one or both of the arms of the wearer from injury, depending on whether one or both of the components are worn.

In the specific embodiment shown in the drawings, each of the left and right arm protecting components 21 can cover an entirety of the arm of the wearer, such as from the wrist to the shoulder. It is to be understood, however, that either or both of the arm components 21 can extend from a position above or below the wrist of the wearer to a position above or below the shoulder of the wearer, depending on the desire of the wearer. Preferably, the left and right arm protecting components 21 are substantially mirror images of one another. It is also to be understood, however, that depending on the desire of the wearer, the left and right arm components 21 need not be the same. Further, either one or both of the arm components 21 can be worn, and can be worn attached to or separate from the upper body component 10, as discussed below.

Although only one of the arm components 21 can be worn, and although either one or both of the arm components 21 can be worn removably or irremovably attached to the upper body component 10, in a preferred embodiment both arm components 21 are worn attached to one another and not attached to the upper body component 10. Specifically, the arm components 21 can be removably attached to one another by a connector 91, details of which are discussed below. The connector 91 can be disposed adjacent the back and shoulder blades, and below the neck, of the wearer. By this arrangement, the arm components 21 can be securely retained on the arms of the wearer, and can be easily put on or taken off. Further, the wearer can avoid the use of extraneous protective garments when only protection of both arms is desired.

Although the drawings show the use of the connector 91 to attach the arm portions 21 to one another, it is to be understood that the arm portions 21 can be removably or irremovably connected to one another, or to other protecting components or garments, by any of the above discussed fasteners or attachment methods. When irremovably connected to one another, attempted removal of at least one of the arm portions 21 can cause damage to the arm portions 21 or the connector.

Figure 5:
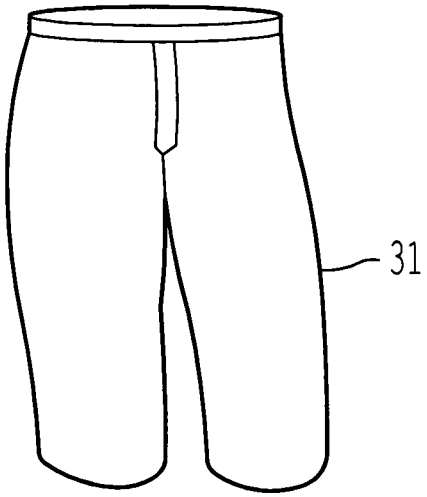
FIG. 5 is an isometric view of a lower body protecting component in accordance with the present invention.

FIG. 5 is an isometric view of a lower body protecting component in accordance with the present invention. The lower body component can be used to protect at least a portion of the lower body of the wearer from injury, such as the waist, hips, thighs, knees, and/or legs.

In the embodiment shown in the figure the lower body protecting component 31 can cover about an entirety of the waist, hips, thighs, knees, and upper legs of the wearer, such as from the waist to below the knees of the wearer. It is to be understood, however, that the lower body component 31 can extend from a position above or below the waist of the wearer to a position above or below the lower leg of the wearer, depending on the desire of the wearer.

Although the lower body component 31 can be worn removably or irremovably attached to the upper body component 10, or other protecting components or garments, in a preferred embodiment the lower body component 31 can remain unconnected. By this arrangement, the wearer can avoid the use of extraneous protective garments when only protection of the lower body is desired.

Figure 6:
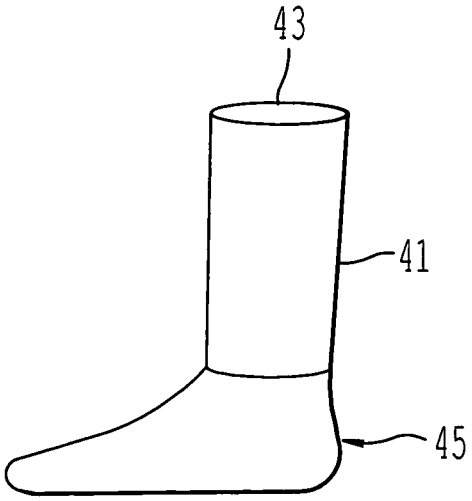
FIG. 6 is an isometric view of a foot and lower leg protecting component in accordance with the present invention.

FIG. 6 is an isometric view of a foot and lower leg protecting component in accordance with the present invention. The foot and lower leg component can be used to protect at least a portion of the foot or lower leg of the wearer from injury. The wearer can use two protecting components when protection of both lower legs is desired, for example.

As shown in the figure, the foot and lower leg component 41 can cover about an entirety of the foot and lower leg of the wearer, such as from the shin to the ends of the toes of the wearer. It is to be understood, however, that the foot and lower leg component 41 can extend from a position above or below the shin of the wearer to a position before the ends of the toes of the wearer, depending on the desire of the wearer.

A top portion 43 of the foot and lower leg component 41 can be made from the above discussed materials that provide protection from injury or resist damage. A bottom portion 45 can be made from a different material. For example, the bottom portion 45 can be made from a material comfortable on the foot of the user, such as nylon, polyester, or cotton.

Although the foot and lower leg component 41 can be worn removably or irremovably attached to the lower body component 31, or other protecting components or garments, in a preferred embodiment the foot and lower leg component 41 can remain unconnected. By this arrangement, the wearer can avoid the use of extraneous protective garments when only protection of the foot or lower leg is desired.

Figure 7:
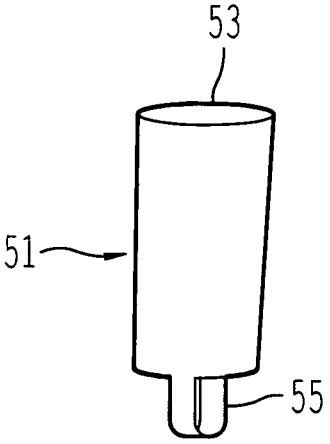
FIG. 7 is an isometric view of a shin protecting component in accordance with the present invention.

FIG. 7 is an isometric view of a shin protecting component in accordance with the present invention. The shin component can be used to protect at least a portion of the shin of the wearer from injury. The wearer can use two protecting components when protection of both shins is desired.

As shown in the figure, the shin protecting component 51 can cover about an entirety of the shin of the wearer, such as from the upper shin to the lower shin of the wearer. It is to be understood, however, that the shin component 51 can extend from a position above or below the upper shin of the wearer to a position above or below the lower shin of the wearer, depending on the desire of the wearer.

The shin component 51 can include a top portion 53 that can cover the shin of the wearer, and can include a bottom portion 55 that is used to secure the component 51 on the wearer. Specifically, the bottom portion 55 can include a stirrup portion to secure the shin component 51 on the wearer.

Although the shin component 51 can be worn removably or irremovably attached to the lower body component 31, the foot and lower leg component 41, or other protecting components or garments, in a preferred embodiment the shin component 51 can remain unconnected. By this arrangement, the wearer can avoid the use of extraneous protective garments when only protection of the shin is desired. It is to be understood that as with all of the protecting components and garments disclosed herein, the shin component 51 can be worn with or without any or all of the other protective components, including the lower body and foot and lower leg components 31 and 41.

Figure 8:
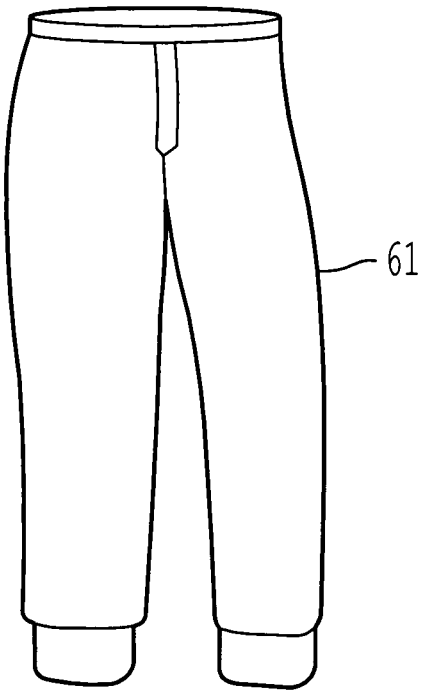
FIG. 8 is an isometric view of a lower body protecting undergarment component in accordance with the present invention.

FIG. 8 is an isometric view of a lower body protecting undergarment component in accordance with the present invention. The undergarment can be used to protect at least a portion of the lower body of the wearer from injury, such as at least a portion of the waist, hips, thighs, knees, or legs of the wearer.

In the embodiment shown in the figures, the lower body protecting undergarment component 61 can be similar to the lower body protecting component 31. However, in a preferred embodiment the undergarment 61 can include an exterior layer made from the above discussed materials that provide protection from injury or resist damage, and an interior layer made from a different material. For example, the interior layer can be made from a material comfortable against the skin of the user, such as nylon, polyester, or cotton. By this arrangement, the undergarment 61 can be more suitable for use as an undergarment worn directly against the skin. Further, although each of the other protecting components can be made thin enough for wear under street clothes or a uniform, the undergarment 61 can have a reduced thickness as compared to these components.

Figure 9:
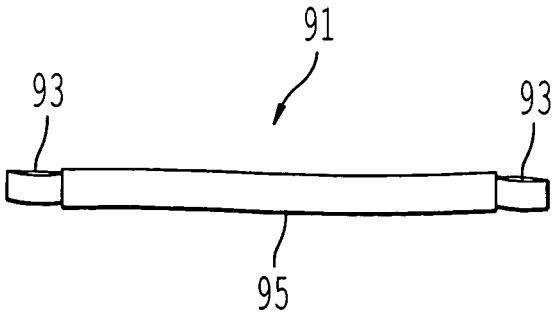
FIG. 9 is an isometric view of a connector for attaching protecting components, in accordance with the present invention.

FIG. 9 is an isometric view of the connector for attaching the protecting components to one another. The connector 91 can include one or more attaching portions 93 and a connected portion 95, and can include the connected portion 95 extending between each of a plurality of attaching portions 93. As shown in the figures, the attaching portions 93 can attach to the protecting components (e.g., the arm components 21), and the connected portion 95 can be used to connect and retain the attaching portions 93. In a preferred embodiment, the attaching portions 93 can removably attach to the protecting components, and the connected portion 95 can be made from an elastic material configured to lengthen in response to the application of a force, and to contract in response to the cessation of the application of the force. It is to be understood, however, that the connector 91 can include one or more attaching portions 93 that do not removably attach to the protecting components, or that the connected portion 95 can be made from an inelastic material.

One or more of the connectors 91 can be used to interconnect various protecting components with one another or with other garments used by the wearer of the modular protective garment. It is also to be understood that any of a variety of removable or irremovable fasteners or attachment methods, including those already known and discussed above, can be used in place of the connectors 91.

Figure 10:
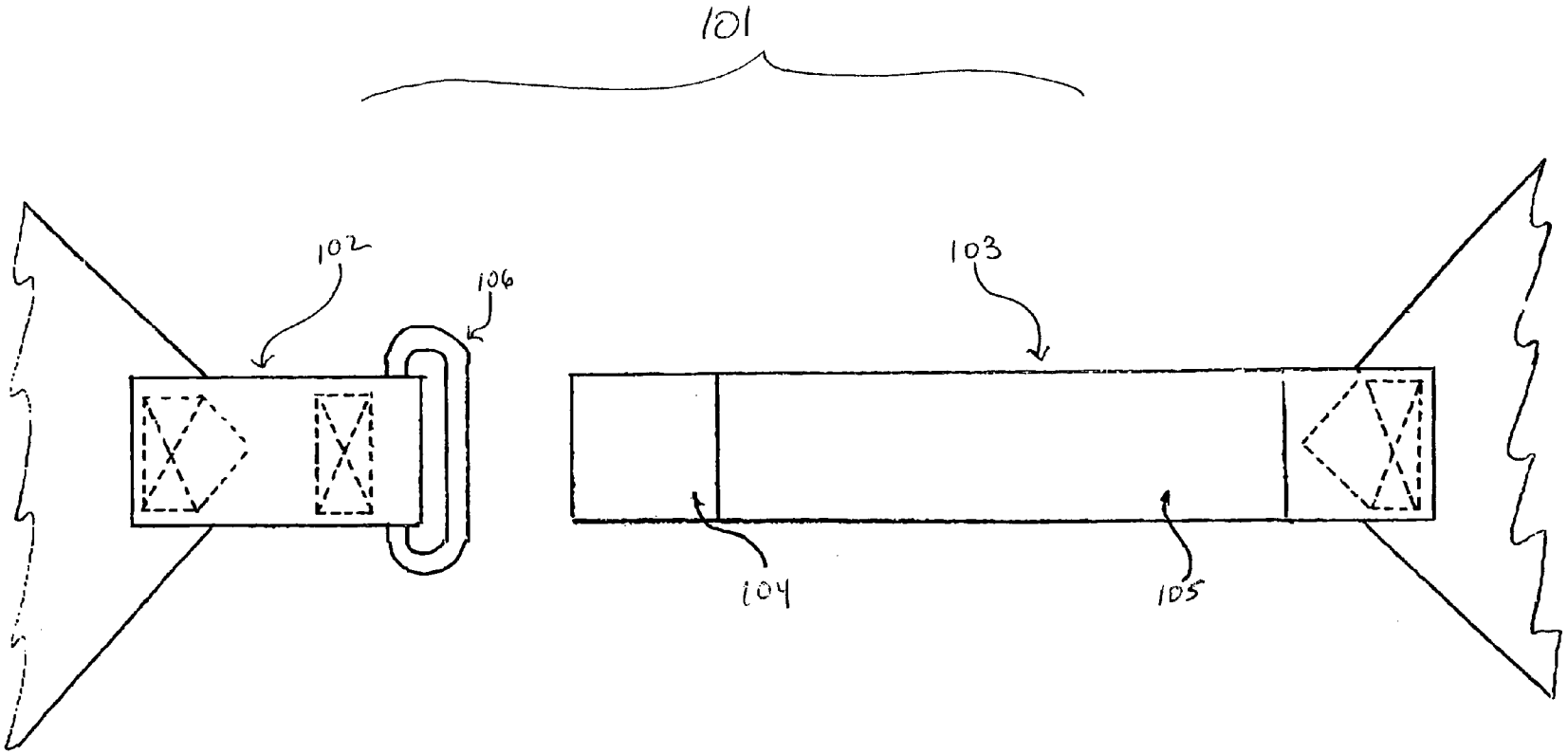
FIG. 10 shows an alternative embodiment of a connector for attaching protecting components, in accordance with the invention.

FIG. 10 shows an alternative embodiment of connector 101, comprising a male portion 103 and a female portion 102, each of which are connected to separate protective garments forming the system of the present invention. Male portion 103 comprises two sections 104 and 105, one of which is a hook section and the other is a loop section, the two sections together forming a hook and loop type of closure (i.e. VELCRO-type). Female portion 102 has at its end distal to the attachment to the protective garment, a loop, grommet or other opening 106, through which the male portion 103 can pass. To form the closure, male portion 103 is passed through the opening 106 in a manner permitting section 104 to be folded back upon section 105, thus engaging the hook and loop closure.

Numerous additional modifications and variations of the present invention are possible in light of the above teachings. It is therefore to be understood that within the scope of the appended claims, the present invention may be practiced otherwise than as specifically described herein.

The invention claimed is:

1. A modular protective garment, comprising:

a first protective component configured to protect a portion of a body of a wearer of the garment;

a second protective component configured to protect a portion of the body of the wearer; and a connector releasably attaching the first and second protective components;

the first and second protective components each, independently, comprising a fabric made from one or more cut and abrasion resistant composite yarns, the fabric permitting air and water vapor to flow therethrough and being light-weight.

2. The garment according to claim 1, wherein the first protective component is made from a fabric that is different from that making up said second protective component.

3. The garment according to claim 1, wherein the first and second protective components are made from the same fabric.

4. The garment according to claim 1, wherein the first component comprises a front component configured to cover a chest of the wearer, and the second component comprises a back component configured to cover a back of the wearer.

5. The garment according to claim 4, wherein the first component comprises a plurality of front components.

6. The garment according to claim 5, wherein the first component comprises a left front component configured to cover a left side of the chest of the user and a right front component configured to cover a right side of the chest.

7. The garment according to claim 6, wherein the connector comprises a set of hook and loop fasteners to secure one of the left and right front components to the back component.

8. The garment according to claim 4, wherein the connector comprises a set of hook and loop fasteners to secure the front component to the back component.

9. The garment according to claim 1, wherein the first component comprises a left arm component configured to protect a left arm of the wearer, and the second component comprises a right arm component configured to protect a right arm of the wearer.

10. The garment according to claim 9, wherein the connector comprises an elastic portion.

11. The garment according to claim 10, wherein the connector further comprises two fasteners, one of the fasteners configured to releasably connect to the right arm component and the other one of the fasteners configured to releasably connect to the left arm component.

12. The garment according to claim 11, wherein the connector is connected to the right and left arm components such that when the garment is worn by the wearer, the connector is disposed adjacent the back and shoulder blades, and below a neck, of the wearer.

13. A modular protective garment, comprising:

a first protective component configured to protect a right arm of a wearer of the garment, the first component permitting air and water vapor to flow therethrough and being light-weight;

a second protective component configured to protect a left arm of the wearer, the second component permitting air and water vapor to flow therethrough and being light-weight; and a connector attaching the first and second components, the connector configured to be disposed adjacent a back and below a neck of the wearer.

14. The garment according to claim 13, wherein the first and second components comprise a same protective material.

15. The garment according to claim 14, wherein the protective material comprises a fabric made from one or more cut and abrasion resistant composite yarns.

16. A method of protecting a person, comprising:

disposing on a wearer a first protective component configured to protect a portion of a body of the wearer and a second protective component configured to protect a portion of a body of the wearer;

the first and second protective components each, independently, comprising a fabric made from one or more cut and abrasion resistant composite yarns, the fabric permitting air and water vapor to flow therethrough and being light-weight; and attaching the first and second protective components.

17. The method according to claim 16, further comprising:

separating the attached first and second components without damage to either component.

18. The method according to claim 16, wherein the first component is configured to protect a back of the wearer, and the second component is configured to protect a chest of the wearer.

19. The method according to claim 18, further comprising:

disposing on the wearer third and fourth protective components on left and right arms of the wearer; and connecting the third and fourth protective components to one another without connecting the third and fourth components to the first and second components; wherein said third and fourth protective components each, independently, comprise a fabric formed from one or more cut and abrasion resistant composite yarns.

20. The method according to claim 19, wherein the third and fourth components are releasably connected to one another by a connector including an elastic portion.

21. The method according to claim 20, wherein the connector is disposed below a neck and adjacent shoulder blades of the wearer.

* * * * *